United States Patent [19]

Rothmayer

[11] 3,993,318

[45] Nov. 23, 1976

[54] ROLLER-SKATE

[75] Inventor: Karl-Heinz Rothmayer, Grosshesselohe near Munich, Germany

[73] Assignee: Messrs. Adidas Sportschuhfabriken Adi Dassler KG, Am Bahnhof, Germany

[22] Filed: Sept. 23, 1975

[21] Appl. No.: 615,990

[30] Foreign Application Priority Data

Oct. 3, 1974 Germany ..... 2447330

[52] U.S. Cl. ..... 280/11.26; 280/7.13

[51] Int. Cl.[2] ..... A63C 1/26

[58] Field of Search ..... 780/7.13, 11.26, 11.19, 780/11.16, 11.27, 11.28

[56] References Cited

UNITED STATES PATENTS

| | | | |
|---|---|---|---|
| 1,996,671 | 4/1935 | Busby | 280/11.26 |
| 2,190,316 | 2/1940 | Harris | 280/11.26 |
| 2,517,322 | 8/1950 | Kahle | 280/11.26 |
| 2,868,553 | 1/1959 | Rieckman | 280/7.13 |
| 3,235,282 | 2/1966 | Bostick | 280/11.26 |
| 3,414,280 | 12/1968 | Ohashi | 280/11.19 |

*Primary Examiner*—M. H. Wood, Jr.
*Assistant Examiner*—David M. Mitchell
*Attorney, Agent, or Firm*—Marn & Jangarathis

[57] ABSTRACT

A roller skate in which plate-like members having means securable to the foot of a wearer, are longitudinally slidable along a guide rail. The mounting members for the roller pairs are also longitudinally slidable in a recess in the bottom of the guide rail and the plate-like members and the roller mounting members are securable at a desired position along the guide rail. The plate of an ice skate may alternatively be inserted in the recess in the guide rail.

7 Claims, 7 Drawing Figures

ROLLER-SKATE

The present invention relates to roller skates. One particularly known form of roller skate has a longitudinally adjustable foot rest or support formed of two plate-like members which are mutually adjustable, in the longitudinal direction of the skate, on a guide element and to which the means retaining the foot are secured. The longitudinal adjustability of the two foot rest plates enables adaptation to various sizes of feet or boots. In the known longitudinally adjustable roller skates the pairs of rollers secured to the two foot rest plates are necessarily adjusted together with adjustment of the foot rest plates. Thus, in the known roller skates the pairs of rollers cannot be adjusted independently of the actual setting of the foot rest plates.

According to the invention there is provided a roller skate comprising a guide rail, first and second plate-like members longitudinally slidable along said guide rail, foot-retaining means carried by said plate-like members, first and second roller mounting members longitudinally slidably mounted on said guide rail, at least one roller mounted on each said roller mounting member and means for locking said plate-like members and said roller mounting members to said guide rail.

With such a construction it is possible to obtain optimum running characteristics of the roller skate and to adapt to individual factors (e.g. weight and height) of the user and for the respective requirements (figure skating, speed skating), because the pairs of rollers can be adjusted independently of the foot rest plates.

Preferably the guide rail for the mountings of the pairs of rollers has at its underside a recess or groove extending in longitudinal direction of the rail into which recess a plate forming a constituent of a roller pair mounting can be slid, a web portion supporting the axles of the two rollers projecting from the underside of said plate. Since this web portion may be of relatively narrow form and, transversely of the longitudinal axis of the roller skate, need only be at most 0.5 to 1.0 centimeters wide, there results for the running characteristics of the roller skate the advantage that the inner ends of the rollers forming part of one pair of rollers may be moved as close together as is practicable, so that the outwardly situated end of the rollers need not protrude beyond the edge of the sole of the boot or shoe.

Since in the longitudinally adjustable roller skate according to the invention the rollers are as readily replaceable, roller mounting members of the roller skate may also be used for fitting rollers of diverse design, to relate to the shape and/or the material (metal or plastics). Thus worn or damaged rollers may be replaced by new ones in a simple manner. Thus, the invention also affords the possibility of equipping the roller skate with rollers particularly suitable for figure skating, i.e. rollers which have a cambered shape with outwardly tapering cross-sectional surface. In conjunction with the earlier mentioned measure, that the web portion carrying the roller axles is of particularly narrow configuration, it is possible to optimally utilize the characteristics of such rollers.

In order to increase the utility of the skate it is proposed for the recess provided at the underside of the guide rail to be adapted for receiving the plate supporting an ice skate.

When the guide rail provided in the roller skate of the invention is formed as a separate element, it may be made of metal, e.g. aluminum, whereby the member supporting the roller mountings obtains adequate stability even when the foot rest plates arranged on the guide rail are made of plastics material. The roller mounting members which are preferably T-shaped, the transverse web forming the mounting plate insertable into the guide rail, preferably also consist of metal, e.g. aluminum.

In order that the invention will be fully understood, the following description is given, merely by way of example, reference being made to the accompanying drawings, in which:

FIG. 1 is a perspective view of one embodiment of roller skate according to the invention;

FIGS. 2*a* and 2*b* are views from below, in perspective of the two parts forming the foot rest members;

Figure 1:
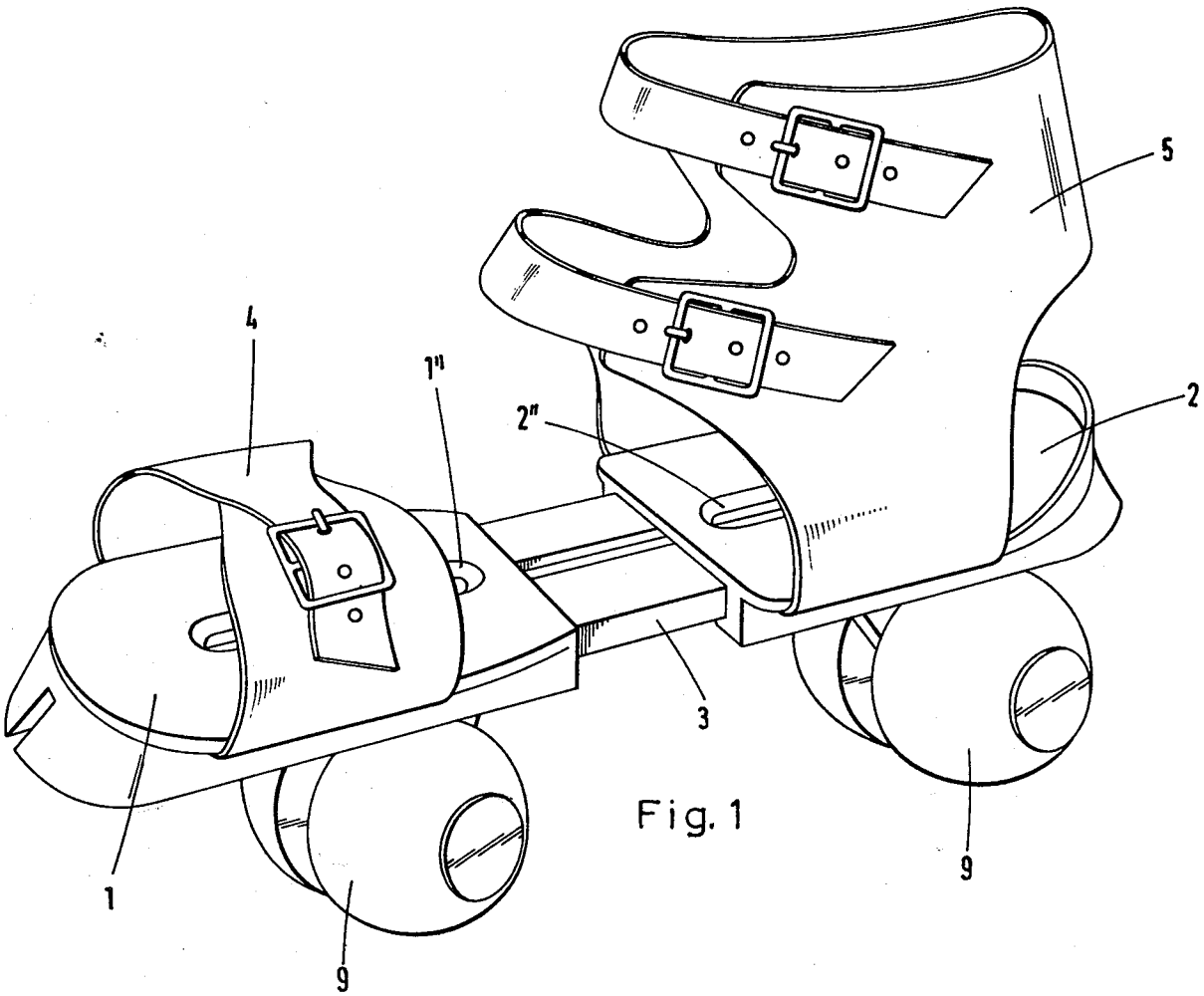
Figure 2B:
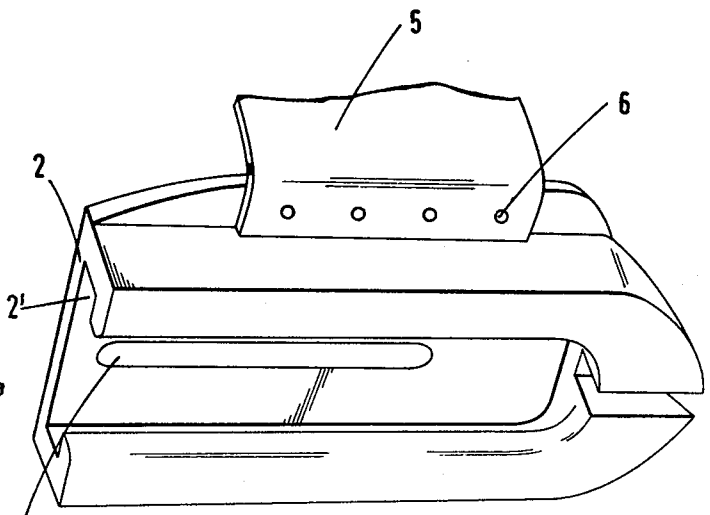
Figure 2A:
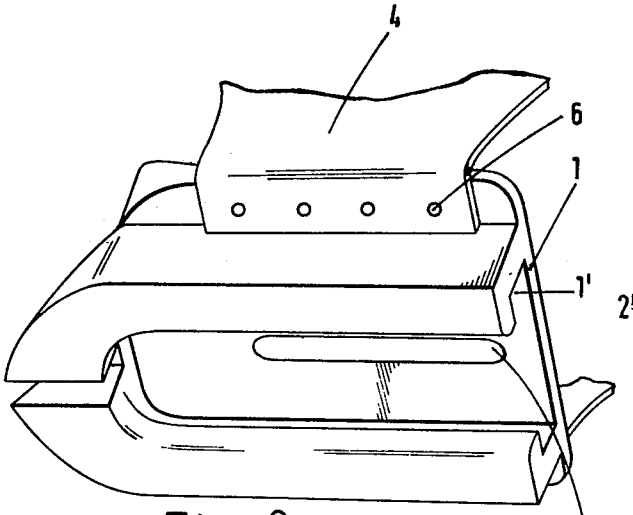
Figure 3:
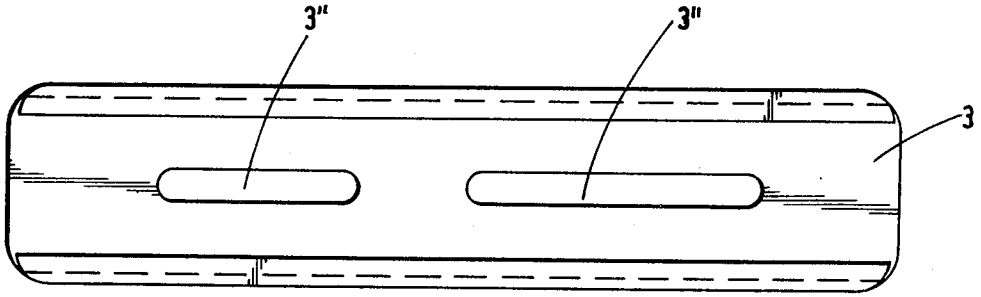
FIG. 3 is a view from below of the guide rail on which the members shown in FIGS. 2*a* and 2*b* are disposed for longitudinal displacement.
Figure 5:
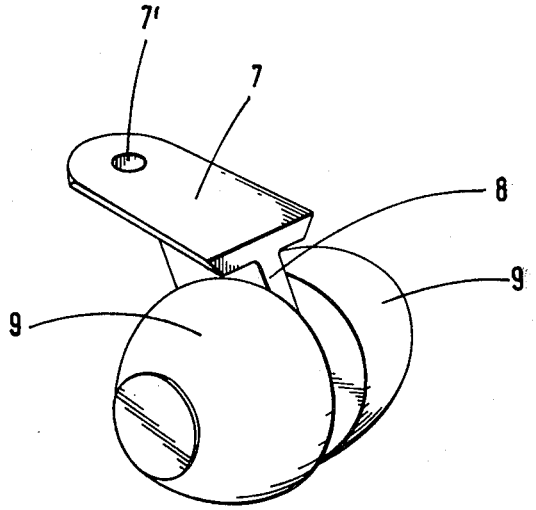
Figure 6:
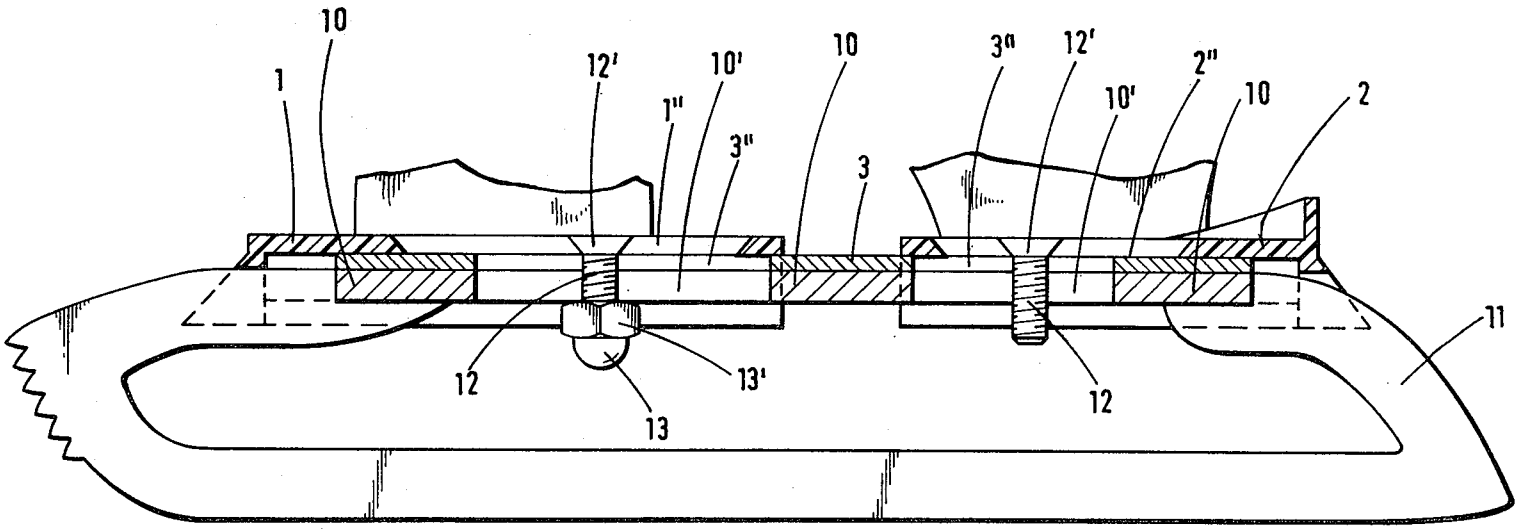

FIG. 5 shows in perspective the unit for replaceable securing to the roller skate which unit is formed of a pair of rollers and its mounting; and FIG. 6 shows a piece of sports equipment (omitting the foot retaining means) obtained by replacing the rollers of the embodiment of FIG. 1 by an ice skate, in vertical section parallel to the longitudinal axis outwardly of the runner proper of the ice skate.

The foot rest of the roller skate according to the invention is formed by two plate-like members 1 and 2 which are displaceably disposed on a guide rail 3, so that the spacing of the outwardly situated ends of the parts 1 and 2 can be adjusted and set to correspond to the respective size of a particular user's boot or shoe.

Figure 4:
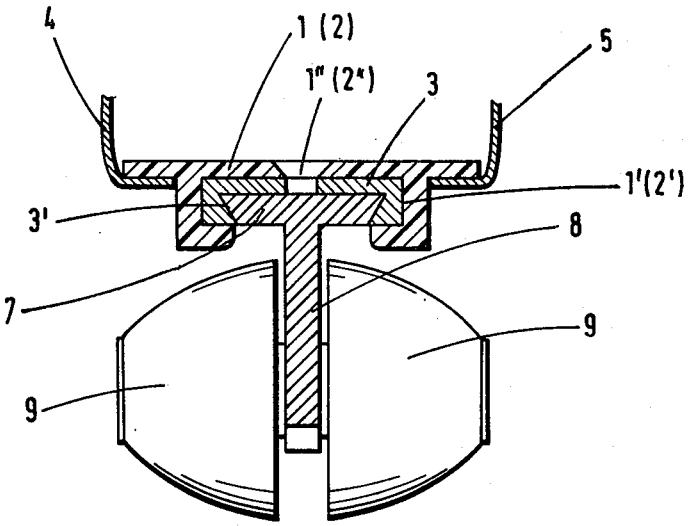
FIG. 4 is a vertical section through the roller skate, perpendicular to the longitudinal axis thereof, in the region of the mounting of a pair of rollers.

The members 1 and 2 forming the foot rest and to which means 4 and 5 retaining the foot, which may for example consist of leather or plastics and are of known design, are secured by rivets 6, are at their underside formed as rail 1' or 1'' for insertion of the guide rail 3, i.e. in such manner that the rail 3 is inter-engageably embraced by the parts 1, 2 as is shown in FIG. 4.

A groove 3' formed in the undersurface of the rail 3 and extending longitudinally thereof has a dovetailed cross-section, as has the plate portion 7 of a roller mounting member, so that the latter can also interengageably be inserted into the rail 3, as is shown in FIG. 4. A comparatively thin web portion 8 carrying the axles (not shown) of the two rollers 9 projects downwardly from the mounting member plate 7. Mounting of the rollers 9, which have a cambered configuration with outwardly reducing cross-sectional surface, may be effected by means of one or more ball bearings, not shown.

As a result of the special design of the mounting members 7, 8 for the pair of rollers 9, the inwardly situated ends thereof may be brought to a comparatively small spacing from one another so that the outwardly situated ends of the rollers need not laterally protrude beyond the roller skate (see FIG. 4), which would adversely affect the running characteristics of the roller skate.

The recess 3' of the guide rail 3 is designed for optional receipt of the plate 10 supporting an ice skate 11, so that the two pairs of rollers may be replaced by an ice skate and a new sports element is thus obtained in simple manner. To this end it is merely necessary to remove the two roller mounting elements, as per FIG. 5, from the groove 3', of the guide rail 3 and insert the plate 10 carrying the ice skate 11 (see FIG. 6).

Along their longitudinal axis the two plates 1, 2 of the foot rest have slot-like openings 1'' and 2'' which may be brought to register with the two correspondingly arranged slots 3'' of the guide rail 3. Furthermore, the plates 7' of the roller pair mountings and the plate 10 carrying the ice skate 11 have openings 7' and 10' respectively which can also be made to register, within the range of the desired adjustability, with the slots 1'', 2'' and 3''. Having set the foot rest plates 1, 2 and the roller pairs 9 or the ice skate 11 in the desired position relative to the guide rail 3, it is in this manner possible mutually to fix these elements by means of fastening means, e.g. bolts. This is illustrated in detail in FIG. 6. The fixing bolts 12 have a frustoconical head 12' of comparatively large diameter which can engage into the conically downwardly, (over the width of the support plates 1,2) tapering slots 1', 2' (see FIG. 4). A cap nut 13 can be threaded onto the lower end of the bolts 12 which nut, when tightened, will be urged against the underside of the plate 7 of the roller mounting member or the plate supporting the ice skate.

I claim:

1. A roller skate comprising:

first and second foot rest members including means for retaining a foot on one side thereof, said foot rest members including a longitudinally extending recess formed on the opposite side thereof;

a guide rail disposed within said longitudinally extending recess of said foot rest members, said guide rail including a longitudinally extending recess formed on a side opposite that for receiving said foot rest members;

first and second roller mounting members comprised of an upper plate portion, a downwardly extending web portion and at least one roller mounted to said web portion, said plate portion of said roller mounting members being slidably positioned within said longitudinally extending recess of said guide rail; and a locking means for selectively and independently fixing the relative position of each of said foot rest members, said roller mounting members and said guide rail.

2. The roller skate as claimed in claim 1 wherein the width of the web portion, transversely of the longitudinal axis of the roller skate, is between 0.5 and 1.0 centimeters.

3. A roller skate comprising:

first and second foot rest members including means for retaining a foot one side thereof, said foot rest members including downwardly and longitudinally extending arm members forming longitudinally extending recess on the opposite side thereof;

a guide rail inter-engageably disposed within said longitudinally extending recess of said foot rest members, said guide rail including downwardly and longitudinally extending arm members forming a longitudinally extending recess of a side opposite that for receiving said foot rest members;

first and second roller mounting members comprised of an upper plate portion, a downwardly extending web portion and at least one roller mounted to said web portion, said plate portion of said roller mounting member being slidably positioned within said longitudinally extending recess of said guide rail; and a locking means for selectively and independently fixing the relative position of each of said foot rest members, said roller mounting members and said guide rail.

4. The roller skate as defined in claim 3 wherein said foot rest members are formed of a plastic material.

5. The roller skate as claimed in claim 3 wherein said roller has a cambered configuration with an outwardly reducing cross-sectional surface.

6. A roller skate comprising:

first and second foot rest members including means for retaining a foot on one side thereof, said foot rest members including a longitudinally extending recess formed on the opposite side thereof;

a guide rail disposed within said longitudinally extending recess of said foot rest members, said guide rail including a longitudinally extending recess formed on a side opposite that for receiving said foot rest members;

first and second roller mounting members comprised of an upper plate portion, a downwardly extending web portion and at least one roller mounted to said web portion, said plate portion of said roller mounting member being slidably positioned and inter-engageable in dovetail relationship within said longitudinally extending recess of said guide rails; and locking means for fixing relative position of said foot rest members and said roller mounting members to said guide rail.

7. A roller skate comprising:

first and second foot rest members including means for retaining a foot on one side thereof, said foot rest members including a slot and a longitudinally extending recess formed on the opposite side thereof;

a guide rail disposed within said longitudinally extending recess of said foot rest members, said guide rail including a slot and a longitudinally extending recess formed on a side opposite that for receiving said foot rest members;

first and second roller mounting members comprised of an upper plate portion having an opening therein, a downwardly extending web portion and at least one roller mounted to said web portion, said plate portion of said roller mounting member being slidably positioned within said longitudinally extending recess of said guide rail; and locking means for fixing the relative position of said foot rest members and said roller mounting members to said guide rail by registration of said slots and opening, said locking means including a bolt extending through said slots and opening.

* * * * *